United States Patent [19]

Canterman et al.

[11] 4,063,645

[45] Dec. 20, 1977

[54] SORTING TRAY

[75] Inventors: David Canterman; Thomas Michael Bergin, both of New Salem, Mass.

[73] Assignee: Brand "X" Company, Tucson, Ariz.

[21] Appl. No.: 689,069

[22] Filed: May 24, 1976

[51] Int. Cl.[2] ..... B07C 7/00

[52] U.S. Cl. ..... 209/122

[58] Field of Search ..... 209/123, 122; 206/558, 206/561, 564; 210/20

[56] References Cited

U.S. PATENT DOCUMENTS 3,487,972 1/1970 Swett ..... 220/20

*Primary Examiner*—Allen N. Knowles

*Attorney, Agent, or Firm*—Howard E. Sandler

[57] ABSTRACT

A sorting tray and more particularly a sorting tray and lid assembly having an improved configuration to facilitate sorting of articles thereon, pouring selected articles therefrom and storing selected articles therein.

9 Claims, 3 Drawing Figures

SORTING TRAY

In a workshop, as well as in certain agricultural and industrial applications, it is necessary: to sort different objects which have become intermixed; to pour certain of the objects into a container; and to store, often in an air tight environment, certain or all of the separated objects. Examples of intermixed objects which may require sorting are: sorting nuts from bolts; sorting wood screws from sheet metal screws; sorting seeds and stems from the flower or leaf portion of certain comestibles or other agricultural products; and the like.

Some prior manual sorting devices were mere surfaces upon which to place the objects to be sorted while other manual sorting devices, for example the type illustrated in U.S. Pat. No. 3,747,756, provided a single inclined surface which facilitates the sorting of objects on the inclined surface by providing isolated area for storing certain sorted materials which are caused to gravitate thereto. Nevertheless, none of the prior art devices adequately provided an arrangement which would provide independent inclines surfaces for isolating two portions of intermixed objects.

By means of the present invention which includes a sorting tray with a pair of oppositely transversely extending inclined surfaces a single tray is provided which has the ability to isolate independent sorted portions of intermixed objects.

Still further, the sorting tray of the present invention includes means adjacent one end of at least one of the inclined surfaces which includes a selectively removable plug means which greatly facilitates the ease of removal of materials from such surface.

A still further feature of the present invention includes a lid assembly which has cooperable means thereon to seal the tray from an outside environment and to seal each inclined surface from the other.

These and other objects and advantages of the present invention will become more readily apparent from a reading of the following description and drawings in which:

FIG. 1 illustrates a sorting tray and lid assembly, generally illustrated at 10, which is constructed in accordance with the principles of the present invention and which comprises an upwardly open tray member 12 and a cooperating lid member 14.

Figure 1:
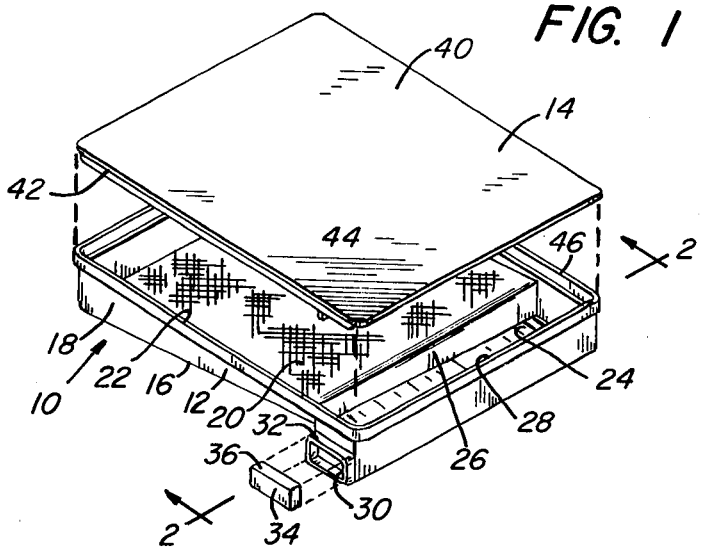
FIG. 1 is an exploded prospective view of a sorting tray and lid assembly constructed in accordance with the principles of the present invention.
Figure 2:
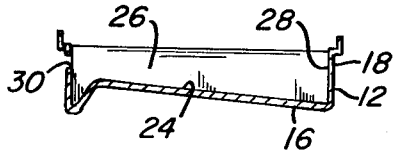
FIG. 2 is a cross-sectional view of the sorting tray taken on lines 2—2 of FIG. 1.
Figure 3:
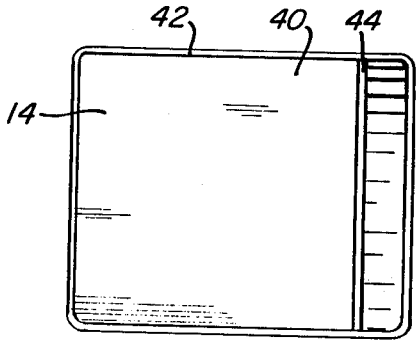
FIG. 3 is a plan view of the underside of the sorting tray lid illustrated in FIG. 1.

Tray member 12 comprises: an elongated upwardly open generally transversely extending body 16 having a wall 18 extending upwardly therefrom adjacent the entire outer periphery thereof. Body 16 includes a main sorting and storage surface 20 which in conjunction with the portion of wall 18 adjacent thereto defines an upwardly open main sorting and storage chamber 22. As illustrated, surface 20 slopes upwardly from one axial end portion of body 16 to the uppermost end thereof which is spaced inwardly from the adjacent axial end portion of peripheral wall 18. Body 16 additionally includes an elongated secondary storage surface 24 which extends transversely of the axial extent of body 16 intermediate the upper axial end of surface 20 and the adjacent end portion of peripheral wall 18. A continuous intermediate wall 26 extends vertically intermediate the inner edge of surface 24 and the axial edge of the upper end of surface 20 which, in conjunction with surface 24 and the adjacent portions of peripheral wall 18, forms an upwardly open secondary storage chamber 28. An additional feature to be noted is that surface 24 slopes downwardly thereby providing a convenient storage area for sorted materials.

Wall 18 includes an opening 30 therethrough adjacent the upper end of surface 24 for facilitating the removal of sorted materials from chamber 28. Opening 30 includes an outwardly extending peripheral lip 32 integrally formed therewith which is cooperable with a formed plug member 34 to selectively sealingly close opening 30. Plug member 34 is formed to generally conform to the peripheral configuration of opening 30 and includes a generally "U" shaped peripheral lip 36 which is adapted to sealingly receive lip 32 therewithin.

With an arrangement of tray member 12 as described hereinabove a user who is sorting intermixed materials, for example an agricultural mixture of seeds, stems and leafy material wherein the seeds and stems are to be separated from the leafy material has merely to place the mixture on the upper portion of surface 20 where he can quite quickly and accurately separate the leafy material into the lower portion of main chamber 22 and separate the seeds and stems into the secondary chamber 28. The slope of surface 24 will result in the separated seeds and stems coming to rest in the lower portion of secondary chamber 28 which, in the event plug 34 is not in position, will be of a substantial aid in preventing the seeds and stems from being thrown or inadvertently deposited on the working area.

Upon completion of the separation of a mixture, tray member may then be utilized as a storage means by use of plug 34 and lid 14. Lid 14 comprises a generally planar body protion 40 having a downwardly open generally "U" shaped seating lip 42 extending continuously around the outer periphery thereof. Lid 14 additionally includes a downwardly projecting flange 44 continuously extending transversely across body portion 40 intermediate the axial ends thereof. Lid 14 is formed to generally conform to the configuration of tray 12 and when sealingly seated thereon, flange 44 will engage body 16 of tray member 12 thereby sealingly dividing storage chambers 22 and 28 of tray member 12. Tray member 12 includes a continuously extending upwardly projecting lip 46 adjacent the uppermost extent of peripheral wall 12 and lid 14 is sealingly received on tray 12 by lip 46 being slidably received within seating lip 42.

Lid and tray assembly 10 may be formed from any suitable material; however, it is intended that the particular embodiment described hereinabove be formed of a resinlike material thereby gaining the advantages of lightness; resistance to impact and corrosion; and the capability of being readily cleaned and sterilized. Inasmuch as articles formed from resinlike material quite often have a relatively low coefficient of friction and it would be undesirable in the instant invention for the mixture deposited on the upper portion of surface 20 to roll down surface 20 before the mixture is sorted the embodiment illustrated in FIG. 1 as having a raised patterned or roughed surface 20.

It is to be noted that it is anticipated that various modifications can be made to the preferred embodiment described hereinabove without departing from the scope of the invention, for example: providing a roughed insert for surface 20 rather than patterning or roughing the surface; an opening and cooperating plug can be provided adjacent the lower end of storage chamber 22; the lid and tray member 12 and 14, respectively, can be structured of alternative cooperating configurations; surface 28 may be of a rounded configuration; surface 20 can have a generally level upper portion and the like. Accordingly, it is to be understood that the scope of the invention is to be interpreted only in accordance with the claims appended hereto.

What is claimed is:

1. A sorting and storage tray comprising: a body portion; a main sorting and storage section of said body portion having at least a lower portion thereof which slopes upwardly to an upper portion thereof; an elongated secondary storage section of said body portion adjacent said upper portion; said secondary storage section extending in a direction generally transverse to said main storage section with the uppermost surface of said secondary storage section which is adjacent said upper portion being no higher than the uppermost planar surface of said main sorting and storage section; and an intermediate wall extending continuously between the uppermost extent of said main sorting and storage section and the adjacent side of said secondary storage section.

2. A sorting and storage tray as specified in claim 1 wherein said main sorting and storage section slopes continuously and the uppermost surfaces of said upper and lower portions lie in a common plane.

3. A sorting and storage tray as specified in claim 1 additionally including an opening adjacent one axial end of said secondary storage section and plug means to selectively seal said opening.

4. A sorting and storage tray as specified in claim 1 additionally including a lid member selectively seatable on said body portion to seal the interior of said body member from an external environment when said sorting tray is used for storage.

5. A sorting and storage tray as specified in claim 4 wherein said lid member includes intermediate sealing means thereon which is cooperable with said body portion to isolate said storage sections from one another when said lid member is seated on said body portion.

6. A sorting tray as specified in claim 5 wherein said intermediate sealing means includes a downwardly depending transversely extending projection which engages said body portion across the width thereof adjacent the uppermost surface of said main sorting and storage section.

7. A sorting and storage tray assembly comprising: a sorting tray member having a pair of contiguous upwardly open storage sections; a lid member selectively seatable on said tray member to seal the interior of said tray member from an external environment; said lid member including intermediate sealing means thereon which is cooperable with said tray member to isolate said storage sections from one another when said lid member is seated on said body member; and with one of said storage sections sloping downwardly from an upper portion thereof and the other of said storage sections being elongated in a direction generally transverse to the slope of said one of said storage sections.

8. A sorting and storage tray assembly as specified in claim 7 wherein the uppermost surface of said other of said storage sections which is adjacent said upper portion is no higher than the uppermost surface of said upper portion.

9. A sorting and storage tray assembly as specified in claim 8 wherein said sealing means includes a downwardly depending transversely extending projection which engages one of said storage sections adjacent the intersection of said storage sections when said lid member is seated on said storage tray.

* * * * *